US005712953A

United States Patent [19]

Langs

[11] Patent Number: 5,712,953

[45] Date of Patent: Jan. 27, 1998

[54] SYSTEM AND METHOD FOR CLASSIFICATION OF AUDIO OR AUDIO/VIDEO SIGNALS BASED ON MUSICAL CONTENT

[75] Inventor: Steven E. Langs, Rochester Hills, Mich.

[73] Assignee: Electronic Data Systems Corporation, Plano, Tex.

[21] Appl. No.: 508,519

[22] Filed: Jun. 28, 1995

[51] Int. Cl.[6] ..... G10L 9/00

[52] U.S. Cl. ..... 395/2.23; 395/2.24; 395/2.17; 395/2.19; 395/2.57

[58] Field of Search ..... 395/2.23, 2.24, 395/2.17, 2.19

[56] References Cited

U.S. PATENT DOCUMENTS

| | | | |
|---|---|---|---|
| 4,433,435 | 2/1984 | David | 395/2.39 |
| 4,574,234 | 3/1986 | Inbar | 324/73 |
| 4,833,717 | 5/1989 | Nakamura et al. | 395/2.15 |
| 4,843,562 | 6/1989 | Kenyon et al. | 364/487 |
| 4,933,973 | 6/1990 | Porter | 395/2.42 |
| 5,305,422 | 4/1994 | Junqua | 395/2.62 |
| 5,323,337 | 6/1994 | Wilson et al. | 364/574 |
| 5,579,431 | 11/1996 | Reaves | 395/2.23 |

*Primary Examiner*—Allen R. MacDonald
*Assistant Examiner*—Vijay B. Chawan
*Attorney, Agent, or Firm*—L. Joy Griebenow

[57] ABSTRACT

An automated system and method for classifying audio or audio/video signals as music or non-music is provided. A spectrum module receives at least one digitized audio signal from a source and generates representations of the power distribution of the audio signal with respect to frequency and time. A first moment module calculates, for each time instant, a first moment of the distribution representation with respect to frequency and in turn generates a representation of a time series of first moment values.

A degree of variation module in turn calculates a measure of degree of variation with respect to time of the values of the time series and produces a representation of the first moment time series variation measuring values. Lastly, a module classifies the representation by detecting patterns of low variation, which correspond to the presence of musical content in the original digitized audio signal, and patterns of high variation, which correspond to the absence of musical content in the original digitized audio signal.

19 Claims, 3 Drawing Sheets

SYSTEM AND METHOD FOR CLASSIFICATION OF AUDIO OR AUDIO/VIDEO SIGNALS BASED ON MUSICAL CONTENT

BACKGROUND OF THE INVENTION

1. Field of the Invention

This invention relates generally to audio signal recognition and classification and more specifically, to automated classification of an audio or audio/video signal with respect to the degree of musical content therein.

2. Description of the Related Art

Automated indexing and filtering of audio/video data is an important element of the construction of systems which electronically store and distribute such data. Examples of such storage and distribution systems include on-demand movie and music services, electronic news monitoring and excerpting, multi-media services, and archiving audio/video data, etcetera. The efficiency of indexing and filtering systems depends on accurate recognition of input data signals. For the sake of understanding, "indexing" refers to the determination of the location of features or events with respect to some coordinate system, such as frame number or elapsed time. Moreover, "filtering" is considered to be the real-time detection of features or events with the purpose of triggering other actions, such as adjusting sound volume or switching data sources.

Machine detection of music in audio tracks is currently a formidable problem for automatic audio/video indexing or filtering systems. Automated indexing and filtering processes are essential because manually processing very large amounts of data, especially in short periods of time, is extremely labor-intensive and because automation offers a consistency of performance generally not attainable by human operators.

Additionally, typical multi-media indexing and filtering applications, such as those mentioned above, are faced with the need to receive properly classified audio/video data from diverse sources. These sources vary widely in the format and quality of the input data. Current detection systems and methods cannot handle such variety in signal quality and format for a number of reasons. For example, such systems rely on separation and processing of high frequency components, which is not possible when sampling rates are low. Moreover, some systems rely on specific characteristics of pure audio signals, such as zero-crossings or peak run lengths, which cannot be reliably measured when the signal to be recognized is mixed with other signals.

There is also a need for the ability to identify an entire class of signals by its general characteristics, as opposed to recognition of a single, particular audio signal instance, such as the recognition of a particular recording of a popular song. Methods of the latter type cannot be used to solve the more general problem except in cases where the definition of a signal class is through the simple enumeration of previously recorded signals. There is a need for a system and method which can recognize the membership of a signal in a general class, even if that signal has not been previously encountered.

To date, most systems and methods in the area of music detection have been solely concerned with the problem of distinguishing between music and speech. This problem has different requirements than that of a general music detector, since, for music-or-speech classification, there is no need to distinguish music from non-music, non-speech sounds. Systems for music-or-speech classification make use of differences exhibited by these two types of signals in their signal power distribution with respect to frequency and/or time. The signal power of speech is concentrated in a narrower frequency band than that of music, and there are differences in power distribution within a signal with respect to time due to phrasing differences between speech and music.

Such power distribution differences are inadequate for a general music detector. For such a detector, it is necessary that musical signals be distinguished from a wide variety of other signals, not just from speech signals. There exist many types of non-musical audio signals which have patterns of power distribution with respect to frequency and/or time which are more similar to music that to speech. Thus a general music detector employing the current systems and methods results in many false positives when applied to signals which have a significant proportion of non-speech, non-music content.

One example of such a music-or-speech system is that discussed in U.S. Pat. No. 5,298,674 to Yun, entitled "APPARATUS FOR DISCRIMINATING AN AUDIO SIGNAL AS AN ORDINARY VOCAL SOUND OR MUSICAL SOUND". Yun's system is a hardware implementation of four separate music/speech classifiers, with the final music-or-speech classification resulting from a majority vote of the separate classifiers. One classifier addresses stereophonic signals by determining whether the left and right channel signals are nearly the same; if so, then the signal is classified as speech, otherwise as music. A second classifier determines whether the signal power in the speech frequency band (400–1600 Hz) is significantly higher than that in the music frequency band (below 200 Hz and above 3200 Hz); if so, the signal is classified as speech, otherwise as music. A third classifier ascertains whether there is low power intermittence in the speech frequency band; if so, the signal is classified as speech, otherwise as music. A last classifier determines whether there is high peak frequency variation in the music band; if so, the signal is classified as music, otherwise as speech.

The measurement of power levels in specific frequency bands is required for the Yun system, which makes it sensitive to aliasing and signal contamination. Further, signal properties such as power band differences, intermittence, and peak frequency variation are specific to the music-or-speech classification problem. This is inappropriate for the applications noted above.

Another music-or-speech system is that found in U.S. Pat. No. 4,541,110 issued to Hopf et al., entitled "CIRCUIT FOR AUTOMATIC SELECTION BETWEEN SPEECH AND MUSIC SOUND SIGNALS". In this system the signal is subdivided into two band limited signals, one covering the 0–3000 Hz band, and the other 6000–10,000 Hz band, corresponding to the voiced and voiceless components of speech, respectively. Null transitions are counted for both signals. Patterns of null transitions, both with respect to time, and with respect to the two frequency bands, lead to a classification as either speech or music. Long, uninterrupted sequences of null transitions which occur either in both frequency bands simultaneously, or in the lower band only, are classified as music. Patterns of null transitions which are interrupted by many short pauses (caused by pauses between syllables, words, etc.) and which occur in one or the other band, but not in both simultaneously (due to the alternation of voiced and voiceless speech sounds), are classified as speech.

This Hopf et al. method requires measurement of power levels in the particular given frequency bands. However, the 6000–10,000 Hz band is either missing or aliased when the sampling rate is 8000 Hz, which is the typical sampling rate for many types of digitized audio tracks. This method is therefore inapplicable to such audio or audio/video material. Additionally, the measurement of null transitions is easily corrupted by the presence of background noise or the mixture of other sounds. The Hopf et al. criteria for classification do not account for the possible presence of non-speech, non-music sounds. Thus, the effectiveness of systems such as that of Hopf et al. is reduced if the particular frequency range required is truncated by filtering, aliased to a different frequency range, or contaminated by aliased frequencies.

A further music-or-speech detection system is that disclosed in U.S. Pat. No. 4,441,203 to Fleming, entitled "MUSIC SPEECH FILTER". According to the Fleming system, components of the signal below 800 Hz are filtered out, thereby removing most speech components, and leaving the remaining signal composed largely of music components which may (or may not) be present. The total power level of the filtered signal is measured, and when above a pre-set threshold, the signal is classified as music.

The Fleming method depends on the absence of non-speech, non-music sounds, since there are many such sounds which have their power band in the 800 Hz and above band, which are erroneously detected as music. Moreover, at the more typical sampling rates (e.g., 8000 Hz) the Fleming method can be defeated by voiceless speech sounds aliased into the 800 Hz and above band. The method also misses musical sounds deleted by an anti-aliasing filter.

A system for detecting music is discussed in the doctoral thesis of Michael Hawley of the Massachusetts Institute of Technology, entitled "Structure out of Sound". The thesis contains descriptions of several sound processing algorithms which Hawley developed, one of which detects music. The Hawley music detector operates by taking advantage of the tendency of a typical musical tone to maintain a fairly constant power spectrum over its duration. This tendency causes the spectral image of musical sound to exhibit "streaks" in the time dimension, resulting from power spectrum peaks being sustained over time. A spectral image shows signal power, with respect to frequency and time, as a grey level image with log power level normalized to the pixel value range of 0 (low power) to 255 (high power). Hawley's detector automatically measures the location and duration of such streaks by finding "peak runs". A peak is a local maximum, with respect to frequency, of the power spectrum sampled at a given time. The spectral image is constructed by moving a Fast Fourier Transform ("FFT") window along the signal by regular increments. At each window position, a single power spectrum is taken. Each of these spectra forms a single vertical "slice" of a spectral image. Thus, a "peak run" is a sequence of peaks which occur at the same frequency over successive spectrum samples.

The Hawley music detector tracks the average peak run length of a sound signal over time. If the average run length goes above a threshold, the sound is judged to be musical. Hawley reports a distinct valley in the histogram of average peak run lengths over various types of sound signals. The value at which this valley occurs is used as a run length threshold which works well in separating music from other sounds.

However, the Hawley music detector exhibits some noticeable shortcomings. For example, it tends to be triggered by non-musical signals whose power spectra also exhibit time-extended frequency peaks, such as door bells or car horns. Further, and more important, the detector was found to be "brittle", that is, overly sensitive to any conditions which varied from the ideal, such as noise or errors of measurement. The concept "peak run", while simple and intuitive for humans to perceive, turns out to be difficult to implement as a mechanical pattern recognizer. Small run gaps or frequency fluctuations easily cause the detector to underestimate average run length and miss music segments. Noise, which can cause spectral image areas containing large numbers of scattered frequency peaks, triggers the detection of spurious runs, especially if the pattern recognizer is constructed to tolerate run gaps. Thus, while seeking to automate indexing of audio/video material from sources whose quality widely varies, the brittleness of the Hawley system and method presented a formidable problem.

SUMMARY OF THE INVENTION

In view of the above problems associated with the related art, it is an object of the present invention to provide a system and method for classification of an audio or audio/video signal on the basis of its musical content.

It is another object of the present invention to provide a system and method for classification of an audio or audio/video signal which degrades smoothly in proportion to any non-musical component of a mixed signal and which is tolerant of signals with multiple component signals or noise. Such system and method have a variety of parameters which can be adjusted so as to cause the system and method to accept a controlled level of non-musical signal mixed in with a musical signal while still classifying the mixed signal as music.

It is a further object of the present invention to provide a system and method for indexing or filtering data on the basis of audio features directly processed. It should be understood that such data may be multi-media data.

It is a still further object of the present invention to provide a system and method for classification of an audio or audio/video signal which is not affected by any anti-aliasing filtering which does not destroy the audible characteristics of the signal.

It is yet another object of the present invention to provide a system and method for classification of an audio or audio/video signal which is tolerant of a variety of data formats and encodings, including those with relatively low sampling rates and, hence, low bandwidth.

It is another object of the present invention to provide a system and method for indexing or filtering data on the basis of non-audio features which are processed by means of their correlation with audio features.

The present invention achieves these and other objects by providing an automated system and method for classifying audio or audio/video signals as music or non-music. A spectrum module receives at least one digitized audio signal from a source and generates representations of the power distribution of the audio signal with respect to frequency and time. A first moment module calculates, for each time instant, a first moment of the represented distribution with respect to frequency and in turn generates a representation of a time series of first moment values.

A degree of variation module in turn calculates a measure of degree of variation with respect to time of the values of the first moment time series and produces a representation of the first moment time series variation measuring values. Lastly, a module classifies the representation by detecting patterns of low variation, which correspond to the presence of musical content in the original digitized audio signal, and patterns of high variation, which correspond to the absence of musical content in the original digitized audio signal.

The system and method of the present invention provides improvement over existing systems and methods by using fundamental characteristics of music embodied as components of a digital audio or digital audio/video signal which distinguish musical signals from a large number of non-musical signals other than speech. As a result, the system and method of the present invention provides more accurate identification (or classification) resulting in more efficient and effective indexing and filtering applications for diverse multimedia material.

The system and method of the present invention is better able to process digitally sampled material than existing systems. This is particularly important because multimedia audio data is normally stored in a digital format (such as mu-law encoding), which requires sampling. For example, mu-law encoding at a sampling rate of 8000 Hz is typical. This sampling rate results in a Nyquist frequency of 4000 Hz. All frequency components above the Nyquist frequency are usually filtered out prior to sampling to avoid aliasing. Because the present invention measures the degree of variation of the first moment of the power distribution with respect to frequency in a way not significantly affected by aliasing, it is also not effected by any anti-aliasing filtering which does not destroy the audible characteristics of the signal. This is a significant improvement over existing systems which, as noted above, depend on the identification of signal strengths in a particular frequency range. This also results in the effectiveness of the present invention remaining acceptable if that frequency range is truncated by filtering, or is aliased partially or wholly to a different frequency range, which is an improvement over the existing art.

Another improvement achieved by the present invention over existing systems and methods derives from the statistical nature of the power distribution variation measurement which is used by the present invention. This measurement is based on the first moment of the power distribution. The first moment statistic degrades smoothly in proportion to any non-musical component of a mixed signal. Moreover, the parameters of the present invention can be adjusted to predetermined settings so as to cause the system and method of the present invention to accept a controlled level of non-musical signal mixed in with a musical signal while still classifying the mixed signal as music. As discussed earlier, the methods employed by existing systems tend to be sensitive to signal contamination ("brittle") and fail more rapidly in the face of such contamination.

These and other features and advantages of the invention will be apparent to those skilled in the art from the following detailed description of preferred embodiments, taken together with the accompanying drawings, in which:

BRIEF DESCRIPTION OF THE DRAWINGS

FIG. 1*a* is a graph of the behavior of an example music first moment;

FIG. 1*b* is a graph of the behavior of an example of non-music first moment;

FIG. 1*c* is a graph of the behavior of a first derivative of an example music first moment;

FIG. 1*d* is a graph of the behavior of a first derivative of an example non-music first moment;

FIG. 1*e* is a graph illustrating a refinement of the behavior of an example music first moment;

FIG. 1*f* is a graph of the first derivative of the example music first moment of FIG. 1*e;*

FIG. 1*g* is a graph of the second derivative of the example music first moment of FIG. 1*e;*

DETAILED DESCRIPTION OF PREFERRED EMBODIMENTS

Musical sound is composed of a succession of notes or chords, each of which are sounded for an interval of time. While the notes of a musical performance overlap in time in various ways, the performance can be divided into segments whose boundaries are the points in time at which a new note or notes begins to be played, or at which one or more notes stops being played. During such a segment, the sound signal consists of a harmonic combination of discrete overtones, contributed by one or more notes, whose relative frequency distribution remains nearly constant over the segment. The length of these segments is in general sufficient for the character of the sound to be apprehended by a human listener, typically on the order of a tenth of a second or more.

In contrast to musical sound, most other sounds have power spectra whose distribution varies more continuously and on a shorter time scale than that of music. This reflects an essential difference between musical and non-musical sound which gives music its expressive power. Melody and harmony are conveyed through the perception of musical tones. Perception of tone requires that a spectral distribution of power be maintained for an interval of time sufficient for human apprehension.

The music detector of the present invention preferably uses the same characteristic of musical sound exploited by the Hawley detector discussed earlier, namely, piecewise constancy of the power spectrum over time. The improvement is in the method used to measure this characteristic. The system and method of the present invention measures variation in the spectral power distribution by tracking its first moment.

Figure 1A:
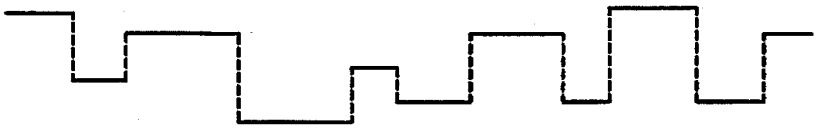
FIGS. 1*a–g* are simplified waveform graphs illustrating behavior of typical audio or audio/video signals as they are processed according to the method of the present invention, specifically.

Given the characteristics of music described above, the first moment of the example musical sound ideally exhibits behavior such as that shown in FIG. 1*a*. At any given moment during musical performance, a set of zero or more musical tones is being played simultaneously. Their power spectra sum to produce the total power spectrum of the sound. This tone set continues to play for a period of time, during which the power spectrum, and hence the first moment, remains constant. Eventually, either at least one of the tones ceases playing, or at least one tone begins playing.

At that point, the power spectrum suddenly shifts to reflect the new tone set. Thus the example first moment exhibits the piecewise constant behavior of FIG. 1*a*.

Figure 1B:
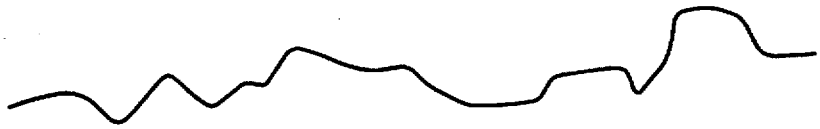

On the other hand, most non-musical sounds have a more constantly varying spectral distribution, and hence a constantly varying first moment, as illustrated with the example waveform in FIG. 1*b*. Such behavior has been confirmed through observation of many types of nonmusical sound, and is especially true of speech.

Figure 1C:
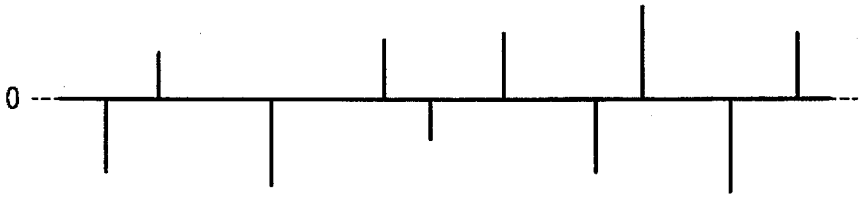
Figure 1D:
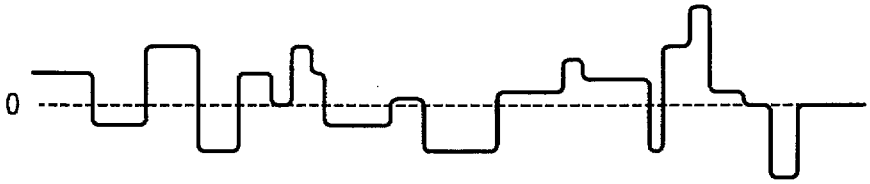

Taking the first derivative with respect to time of the functions in FIGS. 1*a–b*, yields those shown in FIGS. 1*c–d*, respectively. The first derivative of the first moment is almost always zero for music, with spikes occurring where the first moment suddenly shifts due to changes in the set of tones being played. For non-music, the first derivative is usually non-zero, so that, on average, the absolute value of the first derivative of the first moment is much smaller for music than for non-music.

Figure 1E:
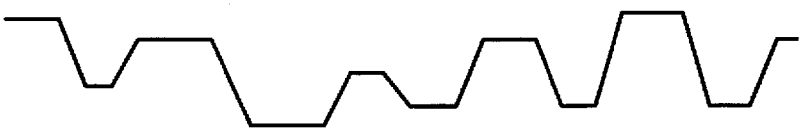
Figure 1F:
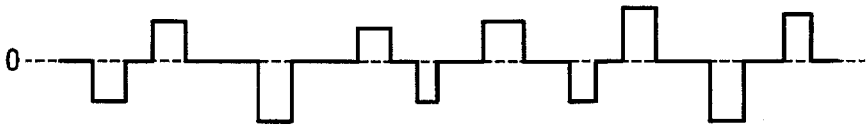

Experimentation has shown, however, that the distinction between musical and non-musical sound is not quite so dramatic as might be expected from examination of FIGS. 1*c–d*. There are a number of reasons for this, including the simplifications built into the described musical performance model. As a result, the following refinement of the performance model has proven to result in better music detector performance. Instead of considering tone set transitions as occurring instantaneously, transitions are preferably assumed to be extended in time, with a gradual shift in first moment values, as shown in FIG. 1*e*. Extended transition events cause the first derivative of the first moment (seen in FIG. 1*f*) to have non-zero values for much longer periods of time. Under this model, the first derivative of the first moment of music much more closely resembles that of non-music. However, using the second derivative results in the spiked behavior shown in FIG. 1*g*, which is similar to that of the first derivative in the previous performance model. Experiments show that using the second derivative of the first moment in fact improves the ability to separate music from non-music, and is therefore more accurate.

Figure 2:
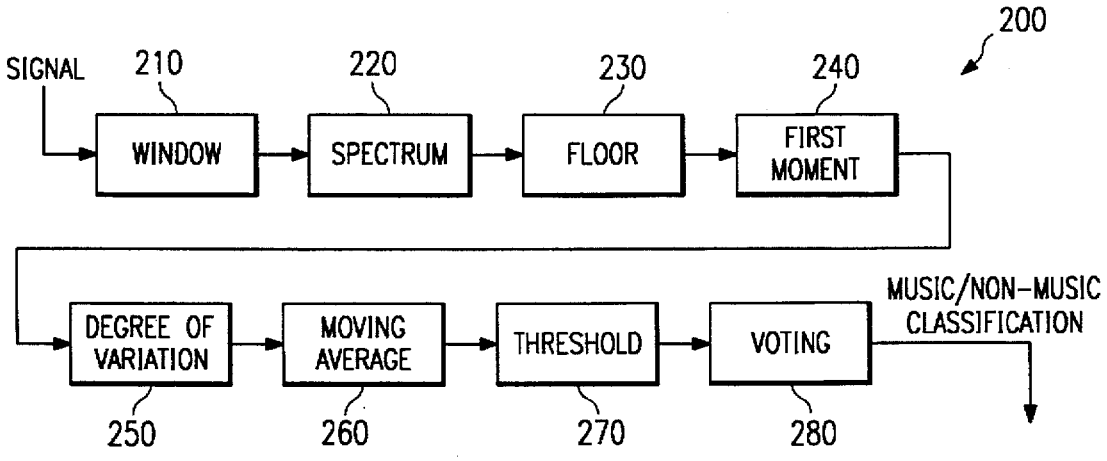
FIG. 2 is a block diagram of an automated music detection system for classifying a signal as music or non-music according to an embodiment of the present invention.

FIG. 2 depicts a block diagram illustrating automated music classification system 200 for classifying an audio or audio/video signal as music or non-music. System 200 consists of a series of software modules 210–280 running as communicating processes preferably on a single general purpose central processor connected to an input unit capable of reading a digital audio signal source. It should be understood that such processes may also be implemented on more than one processor, in which subsets of the modules run as communicating processes on multiple processors thereby implementing a data pipeline, with modules communicating in the order illustrated in FIG. 2, and with inter-processor communication requirements as described by the input/output specifications of the components given below. It should also be appreciated that the particular abstract data structures and numerical quantities employed in the discussion herein can be represented in various ways, are a matter of design choice, and should in no way be used to limit the scope of the present invention.

As an overview, the present invention operates on sampled power spectra of the sound signal. Power spectra are obtained using a Hartley transform employing a Hamming window function. Most tests used a window size of 256 samples. Operating on signals sampled at 8000 Hz (8-bit mu-law encoded), a window size of 256 gives a 128 sample single-sided power spectrum ranging from 0 Hz to a maximum unaliased frequency of 4000 Hz. Thus the spectrum is sampled with a frequency resolution of 4000 Hz/128 or 31.25 Hz.

The sampled power spectra are processed as shown in FIG. 2, and discussed in more detail later. Power spectra are calculated regularly at every 128 input audio samples, or in other words every 0.016 seconds with the sampling rate of 8000 Hz. The spectrum analyzer writes out one block of 128 values for each power spectrum. For each of these, a "noise floor" is taken in which spectral power values below the floor value are forced to zero. The first central moment is then taken, giving the "center of mass" of the power spectrum distribution with respect to frequency.

The sequence of first moment values, one per block, is processed by taking the absolute value of the second derivative, and then smoothed using a moving average. A threshold is used to produce a first music detector output.

Considering FIG. 2 in more detail, system 200 of the present invention receives and processes a digital audio signal. It should be understood that an analog audio signal can also be processed by the system and method of the present invention if it is first digitized. Such digitization can be accomplished using well-known methods. The present invention is not dependent on any particular sampling rate or quantization level for its proper operation. It should also be understood that digital audio signals which are encoded using non-linear coding schemes can be processed by the present invention by first converting them to linear coding using well-known methods. One of ordinary skill in the art will also appreciate that it is possible to employ system 200 to index an audio/video signal by using it to process an audio track which has been separated from such a signal and then re-combining the indexing information derived by system 200 from the processed audio track with the combined audio/video signal.

Window module 210 extracts sample vectors, $I_i=[S_{i,1}, \ldots, S_{i,L}]$ from the input data stream, forms the vector product of each sample vector with a sampled windowing function $W=[W_1, \ldots, W_L]$, and writes the resulting vectors $V_i=[W_1S_{i,1}, \ldots, W_LS_{i,L}]$ to output. Input sample vectors consist of a sequence of consecutive input samples, whose length L is a parameter of the module. In the current embodiment, L is preferably a power of 2, due to the requirements of the spectrum module (see below). Sample vectors are extracted at regular intervals whose length is specified by the parameter D, which is the number of samples separating the first sample of a sample vector from the first sample of the previous sample vector. The size of D determines the number of power spectra which are calculated per unit of time. This means that smaller values of D result in a more detailed tracking of variations in the power spectra, with a correspondingly greater processing burden, per unit of time. D preferably remains fixed during a given signal processing task.

The vector $[W_i, \ldots, W_L]$ consists of values sampled from standard windowing function for spectrum analysis. The use of such functions in spectrum analysis is well known. In the current embodiment, the samples are taken from a Hamming windowing function, although other windowing functions could be used instead.

Thus, the input to window module 210 is $\ldots, I_i, I_{i+1}, I_{i+2}, \ldots$, and the parameters for window module 210 are W, L, and D, where:

$I_i$ is a linearly coded sample of the input audio signal taken at time i.

L is the "window length", i.e., the number of consecutive samples placed in each output window vector.

D is the "window delta", i.e., the number of samples by which the first sample of an input sample vector is offset from the first sample of the previous sample vector.

W is a vector $[W_1, \ldots, W_L]$ of samples from the windowing function.

The implementation of the window module is based on a circular list buffer. The buffer holds L samples at a time, and is initialized by reading into it the first L samples of the input signal. The module then enters a loop in which (1) the samples in the buffer are used to form the next vector $V_i$, which is written out, and then (2) the buffer is updated with new samples from the input stream. These two steps are repeated until the entire input signal is processed. As a result of this processing, window module 210 outputs $\ldots, V_i, V_{i+1}, V_{i+2}, \ldots$.

In step (1), samples from the buffer are multiplied with the window function sample vector. A pointer is kept which indicates the oldest element in the buffer, and this is used to read the samples from the buffer in order from oldest to newest. The product $[W_1S_{i,1}, \ldots, W_LS_{i,L}]$ is formed in a separate buffer and then written.

The manner in which the buffer is updated in step (2) depends on the relationship between L and D. If D<L, then for each loop the oldest L−D samples in the buffer are overwritten by new input samples, using the oldest sample pointer, which is then updated. If D≧L then the entire buffer is filled with new samples for every loop iteration.

Spectrum module 220 receives the output from window module 210 and applies the parameter L, which is the "window length", i.e., the number of consecutive samples placed in each output vector of module 210. Spectrum module 220 implements a method of discrete spectral analysis; any one of a variety of well-known discrete spectral analysis methods (e.g., fast Fourier transforms and Hartley transforms) can be used. Module 220 operates on the output vectors from window module 210 to produce a sampled power spectrum which approximates the instantaneous spectral power distribution of the input data segment by preferably treating the segment as one period of an infinitely extended periodic function and performing Fourier analysis on that function, the input data having generally been multiplied by a windowing function which attenuates the samples near either end of the data segment in order to reduce the effects of high-frequency components resulting from discontinuities created by extending the data segment to an unbounded periodic function.

The preferred embodiment of the present invention makes use of the Hartley transform, which is performed for each input vector $V_i$, where $V_i$ is the ith output vector produced by the window function. The Hartley transform requires that L, the length of the input vector, be a power of 2. The output vectors $P_i$ which are produced are also of length L. Each $P_i$ is a vector $[P_{i,1}, \ldots, P_{i,L}]$ of spectral power values at frequencies $1, \ldots, L$ for the signal segment contained in the ith input sample vector. The elements of $P_i$ represent power levels sampled at discrete frequencies nQ/L Hz for n=1, . . . , L, where Q is the Nyquist frequency. Since spectrum module 220 is concerned with variation in power distribution and not absolute power levels, no normalization of the sampled power values is performed.

The function of floor module 230 is to amplify variations in the power spectrum distribution input received from spectrum module 220. This is accomplished by setting all power levels below a "floor value", F, to zero, which increases the difference between the highest and lowest power levels occurring in a power distribution, thereby emphasizing the effects of shifting peak frequencies on the first moment. The value of F is a parameter whose optimal setting varies with the type of audio material being processed, and is preferably determined empirically.

Floor module 230 uses a buffer to hold the vector $P_i$, which is composed of the spectral power values produced by spectrum module 220. After each vector is read, each vector element is compared to F, and set to zero if it is less than F. The vector $P^*_i$ is then written directly from the modified buffer, and the next input vector read. $P^*_i$ is a vector $[P^*_{i,1}, \ldots, P^*_{i,L}]$ of values defined as follows:

$$P^*_{i,j} = \begin{cases} P_{i,j} \text{ if } P_{i,j} \geqq F \\ 0 \text{ if } P_{i,j} < F \end{cases}$$

where F is the "floor value".

First moment module 240 calculates the first moment with respect to frequency of the modified power distribution vector $P^*_i$ output from floor module 230. The calculation is performed by reading the input vector into a buffer, calculating the total spectral power T, and then the first moment $m_i$, according to the formulas given below. Both calculations are implemented as simple iterative arithmetic loops operating on $P^*_i$, where:

$P^*_i$ is the ith output vector $[P^*_{i,1}, \ldots, P^*_{i,L}]$ of the floor function.

$m_i$ is the first moment of the vector $[P^*_{i,1}, \ldots, P^*_{i,L}]$, that is:

$$m_i = \sum_{j=1}^{L} j \cdot \frac{P^*_{i,j}}{T}$$

and where $$T = \sum_{j=1}^{L} P^*_{i,j}$$

Degree of variation module 250 calculates the measure with respect to time of the degree of variation of the values output by first moment module 240. The measure calculated is preferably the absolute second difference with respect to time of the sequence of values output by first moment module 240. The calculation is performed using a circular list which buffers three (3) consecutive first moment values. Each time a new first moment value is read, the oldest currently buffered value is replaced by the new value, and the second difference is calculated according to the formula:

$$d_i = \|m_i - m_{i+1}| - |m_{i+1} - m_{i+2}\|$$

where:

$m_i$ is the ith first moment output from the first moment function.

$d_i$ is the absolute second difference of the first moment output.

Figure 1G:
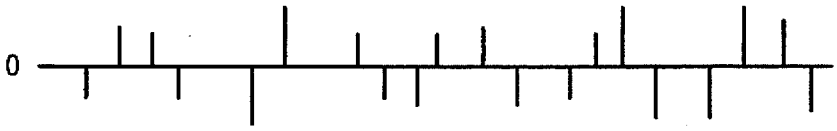

The purpose of degree of variation module 250 is to derive a measure of the degree of variation of the first moment time series. As a review, FIG. 1*e* illustrates the general form of typical first moment behavior over time for musical sound, based on the model of musical performance discussed above and on empirical observation. Taking the second derivative of this function, which is preferred, results in a graph such as illustrated in FIG. 1*g*. It can thus be seen that the second derivative of the first moment of musical sound tends to remain close to zero. This contrasts with the second derivative of the first moment for typical non-musical sound, which has no such tendency. Thus the average level of the absolute value of the second derivative correlates negatively with the presence of a musical component of the input sound signal.

Moving average module 260 implements an order M moving average of the second difference values output by degree of variation module 250. The purpose of module 260 is to counteract the high frequency amplification effect of degree of variation module 250. The output of moving average module 260 provides the trend of the second difference of the first moment over a history of M first moment measurements. The optimal value of the parameter M varies with the type of input audio material and must be determined empirically. Module 260 is preferably implemented using a circular list buffer of size M. Each input value read replaces the oldest buffered value. The output value is calculated by a simple arithmetic loop operating on the buffered values according to the formula:

$$a_i = \frac{1}{M} \cdot \sum_{j=i}^{i+M-1} d_j$$

where:

$d_i$ is the ith absolute second difference output by the second difference function.

M is the moving average window length.

$a_i$ is the moving average of the second differences

Threshold module 270 performs a thresholding operation on the moving average of the second difference of the first moment output . . . , $a_t$, $a_{t+1}$, $a_{t+2}$, . . . , received from moving average module 260. This provides a preliminary classification as to music content of the input sample segment from which the input second difference value was derived. The optimal threshold value T varies with the type of input audio data and must be determined empirically. Threshold module 270 is implemented as a one sample buffer. The current buffer value is compared with T, and a Boolean value of 1 is written if the value is greater than or equal to T, or a 0 is written if it is less. The output of threshold module 270 is . . . , $b_t$, $b_{t+1}$, $b_{t+2}$, . . . and is calculated by the formula:

$$b_i = \begin{cases} 1 \text{ if } a_i \geqq T \\ 0 \text{ if } a_i < T \end{cases}$$

where:

$a_i$ is the ith moving average output by the moving average function.

$b_i$ is the thresholded ith moving average value.

The system and method of the present invention is able to detect the presence of musical components mixed with other types of sound when the musical component contains a significant portion of the signal power. This is due to the fact that the average degree of variation in the first moment is increased by the presence of non-musical components in proportion to the contribution of those components to the signal power. Thus setting the threshold properly allows mixed signals to be detected as having significantly less variation than purely non-musical signals.

Threshold module 270 makes a music/non-music classification decision for every spectrum sample, in other words for the present example, once every 0.016 seconds. This is a much smaller time scale than that of human perception, which requires a sound segment on the order of at least a second to make such a judgment. The purpose of voting module 280 is to make evaluations on a more human time scale, filtering out fluctuations of threshold module 270 output which happen at a time scale far below that of human perception, but recognizing longer lasting shifts in output values which indicate perceptually significant changes in the input signal.

Voting module 280 adjusts the preliminary music classification values . . . , $b_t$, $b_{t+1}$, $b_{t+2}$, . . . output by threshold module 270 to take into account the context of each value, where $b_i$ is the ith value output by the thresholding function. For example, at a sampling rate of 8000 Hz and a window length L of 256 samples, each value output by the threshold module represents a classification of 0.016 seconds of the audio signal. A single threshold module output of "0" (music) in the context of several hundred "1" (non-music) output values is therefore likely to be a spurious classification. Voting module 280 measures the statistics of the preliminary classification provided by threshold module over longer segments of the input signal and use this measurement to form a final classification. Voting module 280 outputs . . . , $c_t$, $c_{t+1}$, $c_{t+2}$, . . . , where $c_i$ is the ith state value.

Voting module 280 maintains a state value, which is either 0 or 1. It outputs its current state value each time it receives a raw threshold value from threshold module 270. A 1 output indicates categorization as music. The state value is determined by the history of inputs from threshold module 270, as follows.

Variables are defined and initialized as follows when system 200 is started: state, initialized to 0; min_thresh and max_thresh, initialized to any values so that min_thresh is less than or equal to max_thresh; vote, initialized to 0; vote_thresh, initialized to min_thresh.

For each threshold value, T, received from threshold module 270, if T does not equal state, then vote is incremented by 1. In effect, threshold module 270 has voted for voting module 280 to change state. If T=state, then vote is decremented, but vote is not allowed to become less than zero.

For every N first level inputs received which do not cause a change of state, the value of vote_thresh is incremented by one, until it reaches the value max_thresh, after which it remains constant until the next change of state. N is a parameter of the algorithm.

If vote ever reaches vote_thresh, then state is flipped to its other value, vote_thresh is reset to min_thresh, vote is reset to zero, and processing continues.

The general effect of the above is to give the variable state "inertia" which is overcome only by a significant imbalance in threshold module 270 votes. The longer state remains unchanged, the higher the inertia, up to the limit determined by max_thresh. As a result there is a tendency to ignore short segments of music within longer segments of non-music, and vice versa. The setting of max_thresh determines the longest segment which will be ignored through this mechanism.

Figure 3:
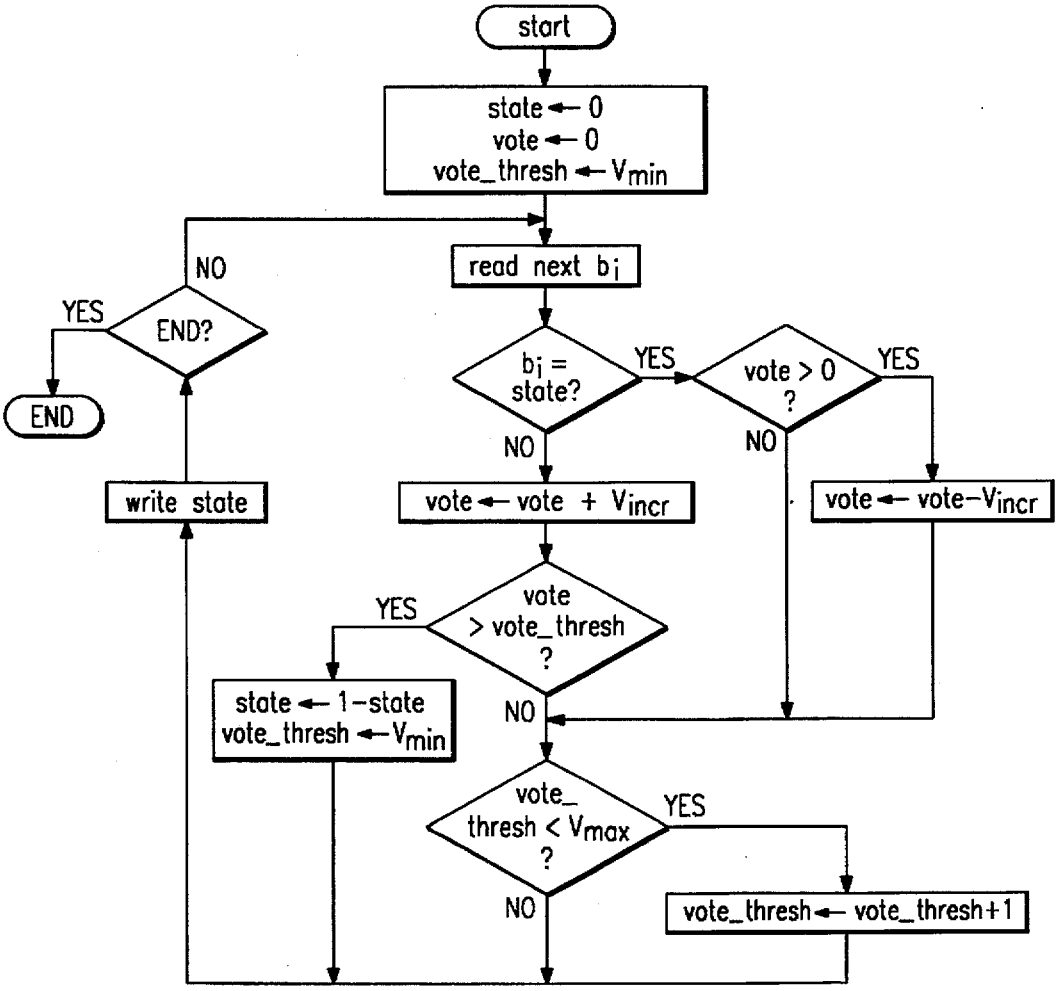
FIG. 3 is a flow chart of the method of the voting module of the present invention.

Voting module 280 may be better understood by reviewing FIG. 3, which illustrates a flow chart of the voting method according to a preferred embodiment of the present invention. At each moment of time, the voting module state reflects its current "judgment" of the input signal as to musical content, either "0" (music) or "1" (non-music). The values received from the threshold module each count as $V_{incr}$ "votes" to either remain in the current state or switch to the opposite state. For example, if the voting module is in state "0", each "1" received from the threshold module is $V_{incr}$ votes to switch state to "1", and each "0" is $V_{incr}$ votes to remain in state "0".

For each time step, the voting module compares the vote counts for switching states and for staying in the current state. If the vote to switch exceeds the vote to stay by a least vote_thresh, then the voting module switches state and resets its vote counts to zero.

The variable vote_thresh increases its value by 1 for each time step, from a starting value of $V_{min}$ up to a maximum of $V_{max}$. Thus, the longer the voting module remains in the same state, the more difficult it is, up to a limit, to cause it to switch to the other state. The value of vote_thresh is reset to $V_{min}$ on every change of state.

The overall effect of voting module 280 is to classify the signal in terms of its behavior over periods of time which are more on the scale of human perception, i.e., for periods of seconds rather than hundredths of a second. The parameters $V_{min}$, $V_{max}$, and $V_{incr}$ can be set according to the type of input signals expected. For example, higher values of $V_{min}$ and $V_{max}$ cause the voting module to react only to relatively long term changes in the statistics of the threshold module output, which would be appropriate for input material in which only longer segments of music are of interest.

The settable parameters of the present invention include:

1) Hartley transform window size.

2) Hartley transform window type. Rectangular, Hamming, and Blackman windows are currently implemented.

3) Hartley transform window delta. The number of audio samples that the Hartley transform window is advanced between successive spectra.

4) Frequency window high and low values. The spectrum analyzer can be set to produce data for only a limited frequency band.

5) The noise floor level

6) Moving average window length. The number of past values used in calculating the moving average.

7) Detector threshold. The threshold value of the averaged second derivative which separates music (below threshold) from non-music (above threshold).

The best values for these parameters were determined through experimentation. The performance of the first level processor showed little sensitivity to parameters 1, 2, and 3. Setting parameter 4 to a low frequency band (for example, 0–500 Hz) showed better performance results than using the full available spectrum. Performance was not sensitive to the exact value of parameter 5, but there was a range of values which produced improved performance over those outside of that range. The values in this range put roughly 10% to 20% of the spectrum power values below the noise floor. Parameter 6 showed similar behavior, in that there was a range of values which gave better results, but performance was not sensitive to the precise value.

Figure 4:
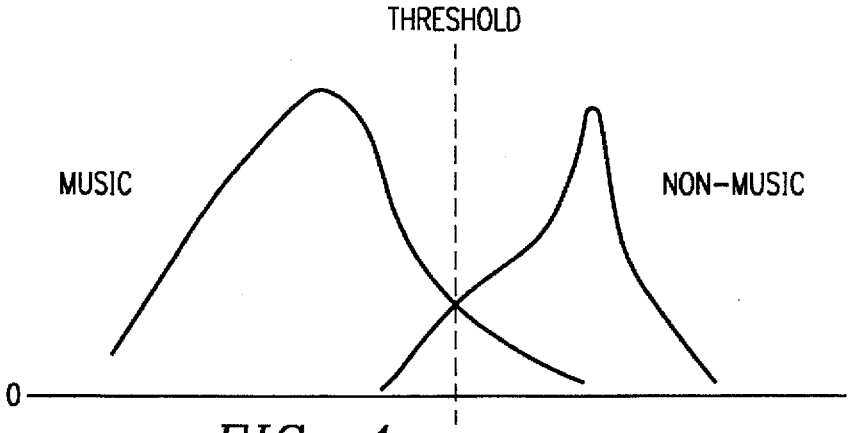
FIG. 4 is an idealized graph of a typical second derivative histogram illustrating overlap of music and non-music portions.

The best value for parameter 7, the detector threshold, varied depending on the other parameter settings. Generally, the histograms of the second derivative values for music and non-music had similar shapes and degrees of overlap over a wide range of parameter settings. The detector threshold was always set in the obvious way to maximize separation, but under no parameter settings was complete separation possible—there was always some degree of overlap between the histograms for music and non-music (see FIG. 4).

Figure 5:
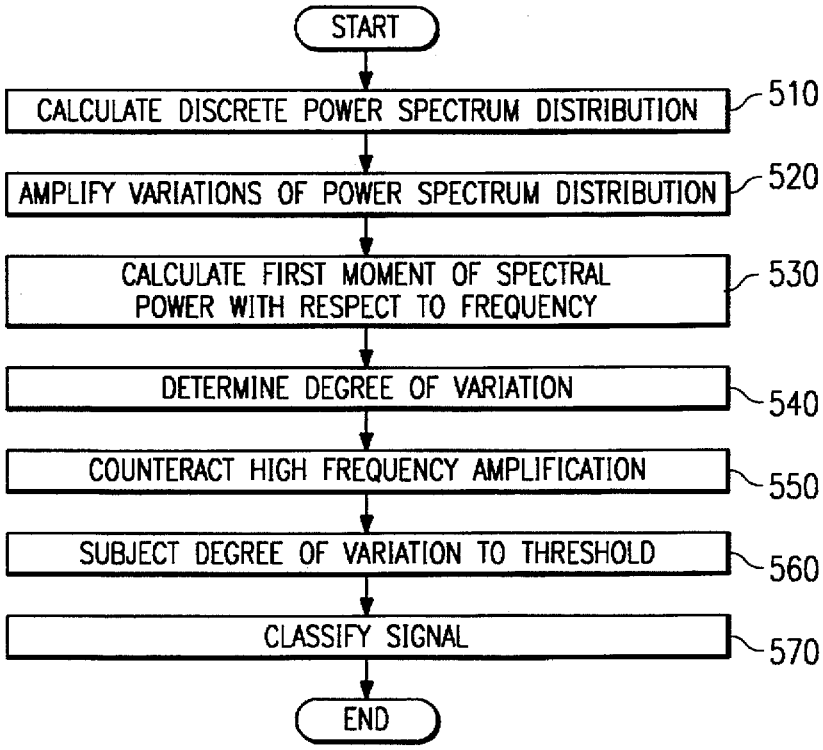
FIG. 5 is a flowchart of a method for classifying a signal as music or non-music according to a preferred embodiment of the present invention.

A preferred method embodiment of the present invention is illustrated in the flow chart seen in FIG. 5. After receiving a digital audio signal input, a discrete power spectrum is calculated (Block 510) for successive segments of the input signal by means of a suitable frequency analysis method, such as the Hartley transform referred to above. This produces a sequence of vectors, ordered by time, each vector describing the power versus frequency function for one segment of the input signal. The variations of the power spectrum is preferably amplified (Block 520) before continuing with the process.

Next, the first moment of spectral power with respect to frequency is calculated (Block 530) for each of the vectors. This results in a sequence of values which describes the variation of the first moment with respect to time. This sequence is then subjected to a measure of the degree of variation (Block 540), such as the second order differential described above.

At Block 550, a moving average is preferably implemented on the degree of variation values generated at Block 540. The degree of variation in the first moment over time is then subjected to thresholding (Block 560), with a lower degree of variation correlating with the presence of a musical component in that part of the input audio signal. The output of the thresholding process is preferably a sequence of Boolean values which indicate whether each successive signal segment exceeds the threshold.

Lastly, the Boolean value sequence produced by thresholding is subjected to a pattern recognizer in which the pattern of Boolean values is examined to produce the final evaluation of the musical content of each signal segment. The purpose of the recognizer is to use the contextual information provided by an entire sequence of threshold evaluations to adjust the individual threshold evaluation of the sequence. In this manner, prior knowledge as to the likely pattern of occurrence of musical and non-musical content can be employed in forming a sequence of adjusted Boolean values which are the final indicators of the classification of the signal with respect to the musical content of the signal segments.

Since the invention operates on the degree of variation of the first moment of the power distribution with respect to frequency, its operation is not affected by the sampling rate of the input audio signal or the frequency resolution of the derived power spectra. The method of the invention is also effective in cases where the range of measurable frequencies is restricted to a narrow band which does not include all frequencies of musical sound, as long as it includes a band which contains a significant portion of the power of both the musical sounds and the non-musical sounds of the signal. Moreover, the present invention is not defeated by aliasing of the signal frequencies being measured, because variations in power distribution in frequencies above the Nyquist frequency show up as variations folded into the measured frequencies.

Figure 6:
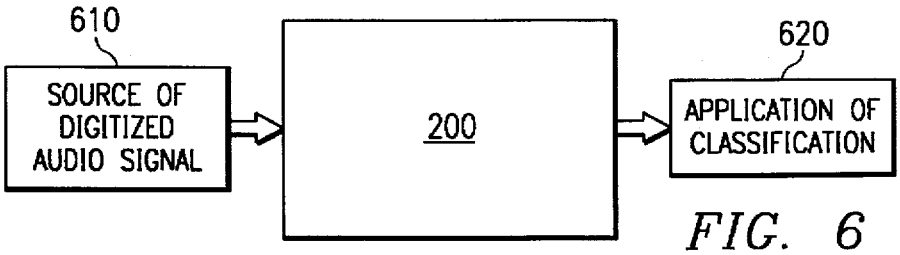
FIG. 6 is a block diagram illustrating the relationship the system of the present invention has with respect to various applications.

FIG. 6 is a block diagram illustrating the relationship system 200 has with respect to application 620. Specifically, a source of digitized audio signal(s) 610 feeds input signals to system 200 to be classified. System 200 provides a continuous stream of decisions (music or non-music) to application 620. Application 620 can be a filtering application, an indexing application, a management application for, say, multimedia data, etcetera. It will be apparent to those of ordinary skill in the art that system 200 can be implemented in hardware or as a software digital signal processing ("DSP") system depending upon the particular use envisioned.

It should be understood by those skilled in the art that the present description is provided only by way of illustrative example and should in no manner be construed to limit the invention as described herein. Numerous modifications and alternate embodiments of the invention will occur to those skilled in the art. Accordingly, it is intended that the invention be limited only in terms of the following claims:

I claim:

1. An automated processing system for classifying audio signals as music or non-music, comprising:

a source of at least one digitized audio signal;

a spectrum module for receiving said at least one digitized audio signal and for generating representations of spectral power distribution with respect to frequency and time of said audio signal;

a first moment module for receiving said generated representations from said spectrum module, for calculating for each time instant first moment of said distribution representation with respect to frequency, and for generating a representation of time series of first moment values;

a degree of variation module for receiving said representation of time series of first moment values from said first moment module, for calculating a measure of degree of variation with respect to time of said values of said time series, thereby producing a representation of first moment time series variation measuring values; and a module for receiving said representation of said first moment time series variation measuring values and for classifying said received representation by detecting patterns of low variation, which correspond to the presence of musical content in said at least one digitized audio signal, and patterns of high variation, which correspond to the absence of musical content in said at least one digitized audio signal.

2. The automated processing system of claim 1, wherein said audio signals are audio signals which have been separated for automated processing from audio/video signals.

3. The automated processing system of claim 1, wherein said spectrum module further comprises a window module for receiving said at least one digitized audio signal, for extracting sample vectors from said signal, and for multiplying said sample vectors with a sampled window function before generating said representations of power distribution with respect to frequency and time of said audio signal.

4. The automated processing system of claim 1, wherein said spectrum module further comprises a floor module for attenuating to zero all values of said generated representations of power distribution with respect to frequency and time which are less than a floor value before they are provided to said first moment module.

5. The automated processing system of claim 1, wherein said degree of variation module further comprises a moving average module for receiving said representation of said first moment time series variation measuring values, calculating a moving average of said variation measuring values, before providing same to said module for receiving said representation of said first moment time series variation measuring values and for classifying said received representation.

6. The automated processing system of claim 1, wherein said measure of degree of variation with respect to time of said values of said time series is the second derivative of said time series of first moment values.

7. The automated processing system of claim 1, wherein said module for classifying said received representation further comprises a threshold module for thresholding said time series of variation measuring values, for producing a time series of logical values indicating whether said variation measuring values exceeded a predetermined threshold, before detecting patterns of said time series of logical values which correspond to presence or absence of musical content in said at least one digitized audio signal.

8. The automated processing system of claim 7, wherein said module for classifying said received representation further comprises a voting module for counting the number of each type of said logical values received, and for classifying said at least one digitized audio signal according to a state variable which holds said voting module's current evaluation of the presence or absence of musical content, wherein said state variable is changed to an opposite evaluation by a preponderance of logical values opposing said current evaluation having occurred since a previous state change, and wherein a level preponderance required for a state change is established by a predetermined time-varying threshold level.

9. The automated processing system of claim 1, further comprising an application for receiving output from said module for classifying said received representation by detecting patterns, and for indexing said at least one digitized audio signal based on said output.

10. The automated processing system of claim 1, further comprising applications for receiving output from said module for classifying said received representation by detecting, and for filtering said at least one digitized audio signal based on said output.

11. The automated processing system of claim 1, further comprising applications for receiving output from said module for classifying said received representation by detecting, and for managing said at least one digitized audio signal based on said output.

12. An automated method for classifying audio or audio/video signals as music or non-music, comprising the steps of:

a. receiving at least one digitized audio signal;

b. generating representations of spectral power distribution with respect to frequency and time of said audio signal;

c. calculating for each time instant first moment of said distribution representation with respect to frequency, and for generating a representation of time series of first moment values;

d. calculating a measure of degree of variation with respect to time of said values of said time series, thereby producing a representation of first moment time series variation measuring values; and e. classifying said received representation by detecting patterns of low variation, which correspond to the presence of musical content in said at least one digitized audio signal, and patterns of high variation, which correspond to the absence of musical content in said at least one digitized audio signal.

13. The automated method for classifying of claim 12, wherein said audio signals are audio signals which have been separated for automated processing from audio/video signals.

14. The automated method for classifying of claim 12, after said step of receiving said at least one digitized audio signal and before said step of generating said representations of power distribution with respect to frequency and time of said audio signal, further comprising the steps of:

extracting sample vectors from said signal; and multiplying said sample vectors with a sampled window function.

15. The automated method for classifying of claim 12, further comprising the step of attenuating to zero all values of said generated representations of power distribution with respect to frequency and time which are less than a floor value before said step of calculating for each time instant first moment of said distribution representation.

16. The automated method for classifying of claim 12, further comprising the step of calculating a moving average of said variation measuring values before said step of classifying.

17. The automated method for classifying of claim 12, further comprising the step of calculating the second derivative of said time series of first moment values as said measure of degree of variation with respect to time of the values of said time series to thereby produce said representation of first moment time series variation measuring values.

18. The automated method for classifying of claim 12, wherein said step of classifying further comprises the step of thresholding said time series of variation measuring values, for producing a time series of logical values indicating whether said variation measuring values exceeded a predetermined threshold, before detecting patterns of said time series of logical values which correspond to presence or absence of musical content in said at least one digitized audio signal.

19. The automated method for classifying of claim 18, wherein said step of classifying further comprises the steps of:

counting the number of each type of said logical values received; and classifying said at least one digitized audio signal according to a state variable which holds a current evaluation of the presence or absence of musical content, wherein said state variable is changed to an opposite evaluation by a preponderance of logical values opposing said current evaluation having occurred since a previous state change, and wherein a level preponderance required for a state change is determined by a predetermined time-varying threshold level.

* * * * *